US006296419B1

(12) United States Patent
Millet et al.

(10) Patent No.: US 6,296,419 B1
(45) Date of Patent: Oct. 2, 2001

(54) DEVICE PROVIDING A CONNECTION BETWEEN A PIVOT AND A MAST STRUCTURE FOR TOWER CRANES

(75) Inventors: Yves Millet, Moulins; Michel Lissandre, Yzeure, both of (FR)

(73) Assignee: Potain (Societe Anonyme), Ecully (FR)

( * ) Notice: Subject to any disclaimer, the term of this patent is extended or adjusted under 35 U.S.C. 154(b) by 0 days.

(21) Appl. No.: 09/444,833

(22) Filed: Nov. 22, 1999

(30) Foreign Application Priority Data

Dec. 21, 1998 (FR) ..... 98 16390

(51) Int. Cl.[7] ..... E04H 12/00

(52) U.S. Cl. ..... 403/408.1; 403/168; 52/651.05; 52/638

(58) Field of Search ..... 403/408.1, 167, 403/168, 235, 378, 379.2, 49; 212/295; 52/651.05, 737.2, 638

(56) References Cited

U.S. PATENT DOCUMENTS

| | | | | |
|---|---|---|---|---|
| 1,643,887 | * | 9/1927 | Gougler | 52/651.05 |
| 2,387,120 | * | 10/1945 | Cohen | 52/638 X |
| 3,360,288 | * | 12/1967 | Holscher | 52/638 |
| 3,365,853 | * | 1/1968 | Holzschuh et al. | 52/638 |
| 3,388,511 | * | 6/1968 | Davidson, Jr. et al. | 52/638 |
| 3,796,018 | * | 3/1974 | Homstrom | 52/638 |
| 3,877,192 | * | 4/1975 | Metailler | 52/638 |
| 3,885,648 | * | 5/1975 | Beziat | 52/638 X |
| 4,949,516 | * | 8/1990 | Long, Jr. | 403/378 X |
| 5,406,767 | * | 4/1995 | Pech et al. | 52/638 |
| 5,956,915 | * | 9/1999 | Piper et al. | 52/651.05 |

FOREIGN PATENT DOCUMENTS

| | | |
|---|---|---|
| 36 28 110 A1 | 2/1988 | (DE) . |
| 0 659 678 A1 | 6/1995 | (EP) . |
| 460983 | 12/1913 | (FR) . |
| 2 519 620 | 7/1983 | (FR) . |

* cited by examiner

*Primary Examiner*—Lynne H. Browne
*Assistant Examiner*—David E. Bochna
(74) *Attorney, Agent, or Firm*—Oliff & Berridge, PLC.

(57) ABSTRACT

The device provides dismantlable assembly between the top of the upper element of the mast of a tower crane and the fixed pivot which serves to support and to orientate the rotating upper part of the crane comprising the jib. Fishplates are fixed at the four corners of the pivot, of square horizontal section, in the direction of the diagonal, the fishplates lying within the permissible size for transporting this pivot. Other fishplates are fixed to the four corners of the top of the mast element, on the inside of the uprights of this element. The fishplates have holes which come into alignment, and through which removable connecting pins are fitted.

9 Claims, 3 Drawing Sheets

DEVICE PROVIDING A CONNECTION BETWEEN A PIVOT AND A MAST STRUCTURE FOR TOWER CRANES

BACKGROUND OF THE INVENTION

The present invention relates, in general, to the industrial sphere of tower cranes and relates, more specifically, to a device providing a connection between a pivot and a mast structure for tower cranes. This device providing dismantlable assembly between, on the one hand, the top of the mast of a tower crane, made up of superposed metallic framework elements of square horizontal section and, on the other hand, a fixed pivot, the envelope section of which is of square overall shape and which serves to support and to orientate the rotating top part of the crane, comprising in particular the jib. In particular, the connecting device that is the subject of the invention is suitable for assembling a pivot of square envelope section with a side of a given length, for example 2.5 meters, with a framework element of square section which has a longer overall length of side, for example longer than 2.5 meters.

In a way which is generally known, the connection between the fixed pivot and the top of the mast, in a tower crane, is provided by fishplate means similar to the means used for the dismantlable assembly between the mast elements of the same crane.

DESCRIPTION OF THE PRIOR ART

Thus, there are tower crane mast elements with vertical corner members (or uprights) of round cross section fitted with tangs at their lower end and with corresponding yokes at their upper ends, removable connecting pins connecting the tangs with the yokes. The pivot is coupled to the upper element of the mast via the legs of this pivot, the construction of which is identical to that of the means provided at the base of the mast elements. An embodiment of this kind is described, in particular, in Chinese utility model No. 94247749.9 in the name of the Applicant, filed on Dec. 22, 1994 and granted on Oct. 29, 1995 with the No. 222090. In this embodiment, the tangs and yokes which provide the connections between the elements are oriented at 45° with respect to the adjacent faces of these elements, and thus extend outside the basic square section of said elements.

The result of this, as far as the pivot is concerned, is a square useful cross section the length of the side of which is limited to about 2.3 meters, for an overall size of 2.5 meters. Furthermore, the overall height of the pivot is, in this case, relatively great.

There are also pivots equipped with fishplate-jointing means designed to suit mast elements the corner members of which consist of L sections. In this instance, reference may be made to French patent application No. 7218577 of May 18, 1972, in the name of the Applicant, published on Dec. 28, 1973 with the No. 2 185 217, which describes a fishplate-jointing device in which the top of an upright bears an inner fishplate in the shape of an angle bracket and two outer fishplates welded to this upright, while inner and outer reinforcements are welded to the base of an upright; this device is equipped with jointing pins which pass through the fishplate and the reinforcements. A device of this kind, when applied to assembling a pivot, entails that, for a pivot with an overall square cross section with a side 2.5 meters long, the square cross section of the mast structure may not exceed a side length of 2.5 meters.

The present invention sets out to avoid the drawbacks and limitations of the current devices for providing connection between pivot and mast structure, and it therefore has the following objectives:

- to improve the characteristics (in terms of the loads handled or the maximum reach) of the tower cranes, these themselves being determined by the dimensions of the pivot, while at the same time allowing them to be transported with the size permitted for road transport, or in standardized containers of the "platform" type;
- to reduce the bulk of tower crane pivots for transport, particularly their overall height.

SUMMARY OF THE INVENTION

To this end, the subject of the invention is essentially a device for providing a connection between a pivot and a mast structure for tower cranes, of the kind specified in the introduction and which comprises, in combination:

- at each of the four corners of the pivot, at least one fishplate fixed in a vertical plane passing through a diagonal of the square horizontal section of the pivot, or parallel to this diagonal, each fishplate being pierced with at least one hole of horizontal axis, and all of the fishplates of the pivot lying within the permissible size for transporting this pivot;
- at each of the four corners of the top of the upper mast element, at least one other fishplate fixed to the upper part of a corner member or upright of this mast element, on the inside of the upright, in a vertical plane passing through a diagonal of the square horizontal section of the mast element or parallel to this diagonal, each fishplate being pierced with at least one hole of horizontal axis, and all of the fishplates of the mast element lying inside the volume delimited by the four lateral regions of the mast element, and
- removable horizontal connecting pins designed to be engaged through the holes in the fishplates of the pivot and the holes in the fishplates of the mast element, these holes coming into alignment at each of the four corners when the pivot is placed on the top of the mast element.

Thus, according to the invention, the connection between the fixed pivot and the upper mast element is achieved by four identical fishplates located at each corner of the pivot, in the plane of the diagonals of the square horizontal section of the pivot. The overall dimension of the fishplates of the pivot is included in the maximum size permitted for ordinary road transport or for transport in containers of the "platform" type, namely 2.5 meters. By contrast, the fishplates of the mast element are located inside the volume delimited by the lateral faces of this element, the pivot can be assembled by a mast element whose horizontal section is a square with a side longer than 2.5 meters. Each fishplate of the device which is the subject of the invention constitutes, from the mechanical point of view, a connection with off-centered neutral axes, transmitting loads between the pivot, the cross section of which has a side length of, for example, 2.5 meters, and the mast structure, the cross section of which has a side length longer than 2.5 meters.

In one embodiment of the invention, each fishplate of the pivot is fixed by welding under a corner region of the upper horizontal plate, generally square in shape, of the pivot. Advantageously, each fishplate of the pivot is also fixed by welding to the adjacent regions of vertical reinforcing pieces located on the four sides of the pivot, under its upper plate, and connected to the shell cylinder of said pivot.

According to a preferred embodiment of the connecting device that is the subject of the invention, the pivot comprises, at each of its four corners, a single fishplate located in the vertical plane passing through the diagonal of the square section of the pivot, whereas fixed to the upper part of each corner member or upright of the mast element are two parallel fishplates which are symmetric with respect to the vertical plane passing through the diagonal of the square horizontal section of the mast element, the two fishplates together forming a yoke in which the corresponding fishplate of the pivot can be inserted.

According to an advantageous arrangement, two superposed holes are pierced in the fishplates of the pivot, and in the fishplates of the mast element, so that two superposed connecting pins can be fitted at each of the four corners. The holes pierced in the fishplates of the pivot just like the other holes pierced in the fishplates of the mast element, are preferably fitted with hammering inserts, intended to increase the area of contact between these fishplates and the connecting pin passing through them, and therefore to reduce the hammering pressure.

According to an additional advantageous arrangement, a horizontal mounting plate is welded to the upper end of each corner member or upright of the mast element, the upper horizontal plate of the pivot coming into alignment, at each of its corner regions, with the corresponding mounting plate. More specifically, the upper plate of the pivot may, in each corner region, bear at least one centering stud, directed downward, whereas each mounting plate of the mast element is pierced with at least one hole capable of accommodating a corresponding centering stud belonging to the pivot. In a particular configuration, each mounting plate of the mast element has a U shape with two branches directed toward the inside of the square horizontal section of the mast element, each branch being pierced with a hole and having a central cutout designed for the passage of the corresponding fishplate of the pivot, the upper plate of the pivot bearing, in each corner region, two centering studs arranged symmetrically one on each side of the fishplate and designed to enter two holes in the corresponding mounting plate.

The collaboration between the holes pierced in the mounting plates and the studs borne by the upper plate of the pivot, centers the pivot with respect to the top of the mast structure when the pivot is set in place, while the crane is being erected, and takes up shear loads between the pivot and the mast structure when the tower crane is in operation.

BRIEF DESCRIPTION OF THE DRAWINGS

In any case, the invention will be better understood with the aid of the description which follows, with reference to the appended diagrammatic drawing which, by way of example, depicts one embodiment of this device for providing a connection between a pivot and a mast structure for tower cranes:

In FIG. 1, the reference 1 denotes the fixed pivot (also depicted by itself in FIG. 2) in its entirety, whereas the reference 2 denotes the upper element of the mast of a tower crane in its entirety.

DESCRIPTION OF THE PREFERRED EMBODIMENT

Figure 1:
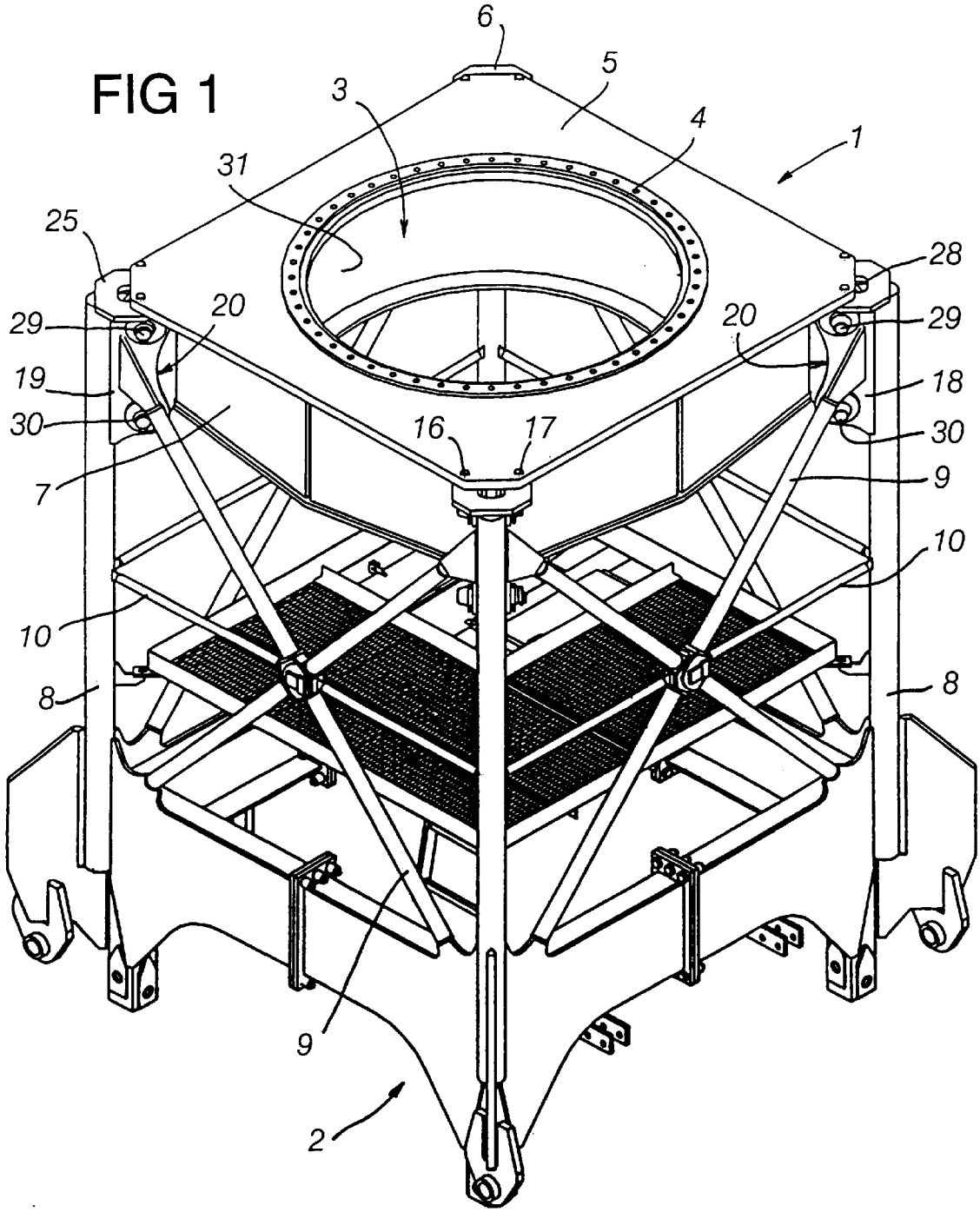
FIG. 1 is an overall view, in perspective, showing a fixed pivot assembled with the upper mast element of a tower crane using the device that is the subject of the invention.

The pivot 1, which serves to support and to orientate the rotating upper part, with jib (not depicted) of the crane, has a horizontal section of square overall shape. This pivot 1 has a circular central opening 3 delimited by the bearing surface of a ring 4. The upper part of the pivot 1 is formed of a square plate 5 interrupted by the central opening 3 and having four corners cut off at 45° as shown at 6. Along its four sides, under the upper plate 5, the pivot 1 also has reinforcing pieces 7 located in vertical planes and connected to a shell cylinder 31. The entire pivot 1 lies inside an envelope of square horizontal section, each side of which has a length denoted by A, equal, for example, to 2.5 meters, corresponding to the side of the square plate 5 (disregarding the cut-off corners 6).

The mast element 2, which also has a horizontal section of square overall shape, but with sides longer than the side length A of the pivot 1, is a framework element which comprises four vertical corner members or uprights 8, joined together by diagonal members 9 and cross members 10 on the four lateral faces of the element 2. In the example illustrated, the uprights 8 and the diagonal members 9 are round sections. As the invention relates to the connection between the pivot 1 and the upper part of the mast element 2, we shall not dwell on the details of the construction of the lower part of this mast element 2, which details can be seen in FIG. 1.

As the connecting device according to the invention comprises identical means at the four corners of the pivot 1 on the one hand, and the upper part of the mast element 2, on the other hand, the following description will describe the means provided at one of these four corners, with reference particularly to FIGS. 3 to 7 which depict details of a corner region, both in the case of the pivot 1 and in the case of the mast element 2.

Figure 2:
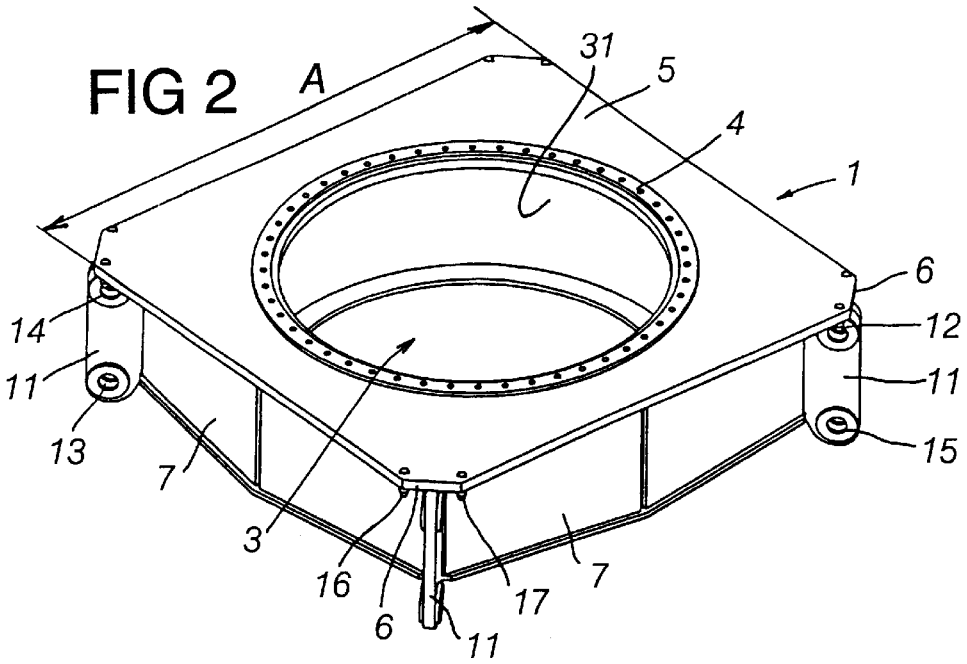
FIG. 2 depicts, in perspective, an overall view of the pivot alone.
Figure 3:
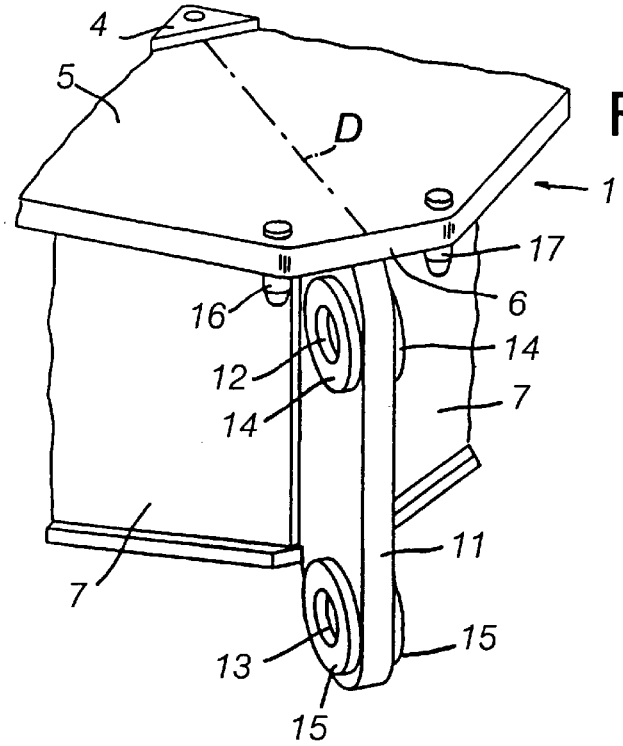
FIG. 3 is a partial view in perspective, to a larger scale, showing details of a corner region of the pivot.
Figure 4:
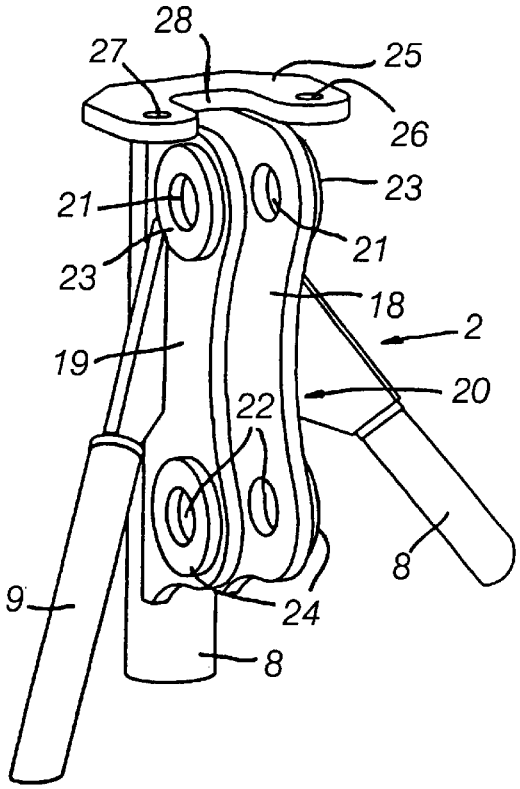
FIG. 4 is a view in perspective showing details of a corner region of the top of the mast element, on which the pivot is assembled.
Figure 5:
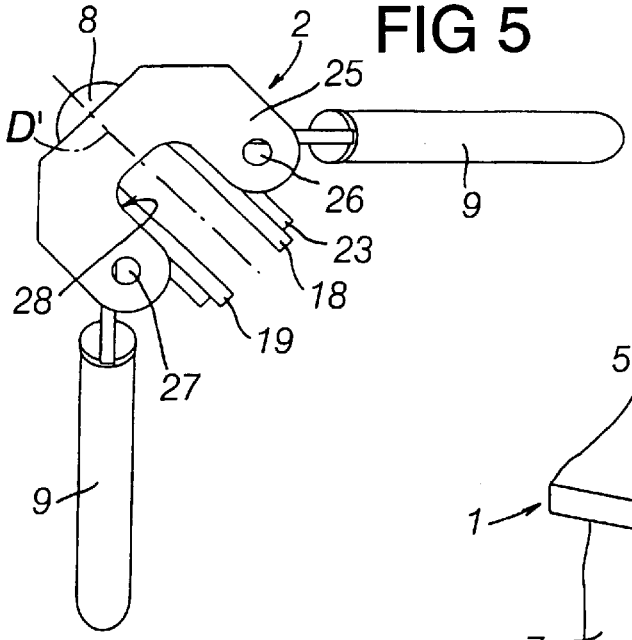
FIG. 5 is a plan view, from above, of the corner region of this mast element.
Figure 6:
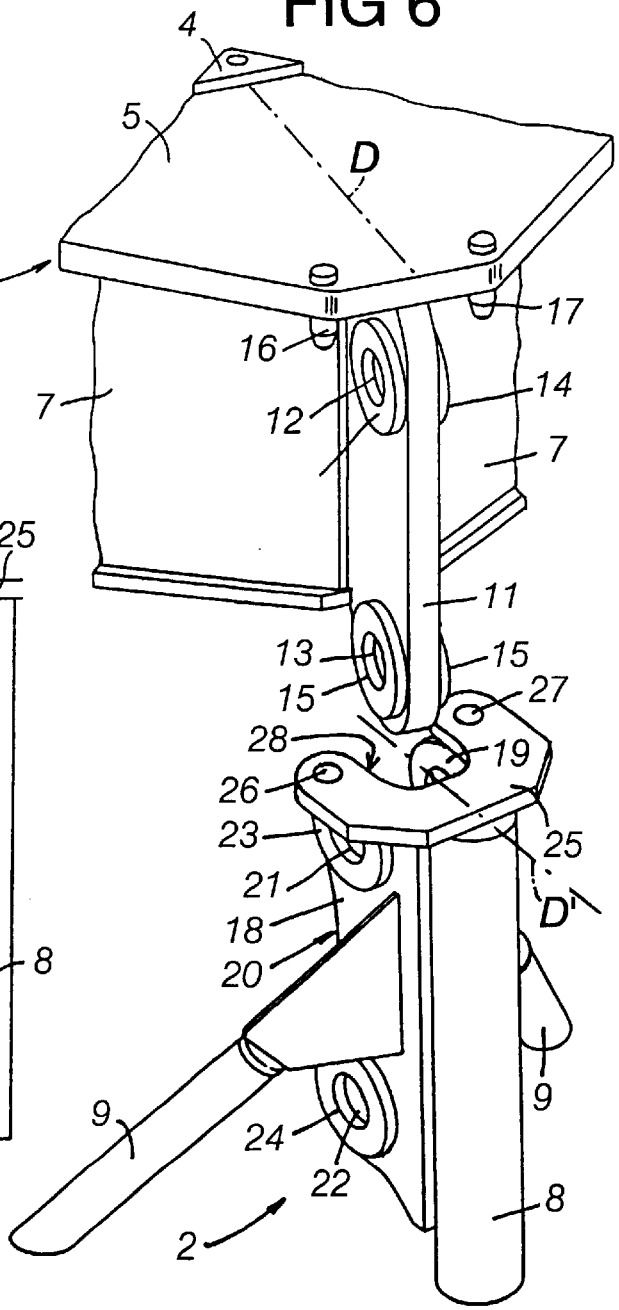
FIG. 6 is a view in perspective illustrating the assembly of the pivot with the mast element, in detail, in one of the corner regions.
Figure 7:
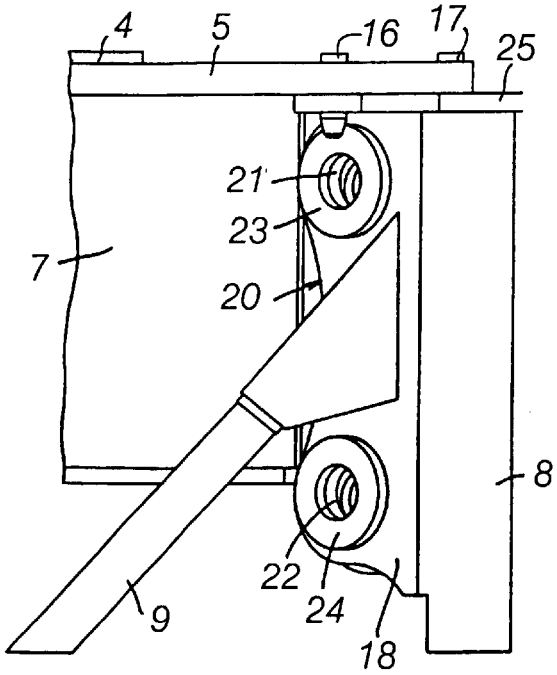
FIG. 7 is a side view corresponding to FIG. 6.

Considering first of all the pivot 1 (see FIGS. 2 and 3), at each corner there is a fishplate 11 forming a tang, located in a vertical plane passing through a diagonal D of the square upper plate 5. The fishplate 11 is welded under this plate 5 and is also welded to the adjacent regions of the vertical reinforcing pieces 7 and is thus set between these reinforcing pieces 7.

The fishplate 11 is pierced with two superposed holes 12 and 13, the axes of these holes being horizontal and parallel. Annular hammering inserts 14 and 15 are welded on each side of the fishplate 11, around the two holes 12 and 13, respectively.

The position of each fishplate 11, and its horizontal dimensions, are determined so that this fishplate 11 lies inside the envelope of square section defined earlier.

Two centering studs 16 and 17 are also welded to each corner region of the upper plate 5 of the pivot 1; the two studs 16 and 17, arranged symmetrically one on each side of the fishplate 11, are oriented vertically and directed downward.

At the top of the mast element 2, and at each corner (see particularly FIGS. 4 and 5), there are two parallel fishplates 18 and 19 which together form a yoke 20. The two fishplates 18 and 19 are welded, in closely-spaced parallel vertical planes, to the upper part of the round-section upright 8. These two fishplates 18 and 19 are thus placed on the inside of the upright 8 and are also, as a result, inside the volume delimited by the four lateral faces of the mast element 2 (the faces in which the diagonal members 9 and cross members 10 lie). The plane of symmetry of the two fishplates 18 and 19 coincides with the vertical plane passing through the diagonal D' of the square horizontal section of the mast element 2.

Each fishplate 18 or 19 of the mast element 2 is pierced with two superposed holes 21 and 22, the axes of these holes being horizontal and parallel, and the vertical spacing of the axes of the two holes 21 and 22 of a fishplate 18 or 19 is equal to the vertical spacing of the two holes 12 and 13 of a fishplate 11 belonging to the pivot 1. Annular hammering inserts 23 and 24 are welded, just on the outside faces of the fishplates 18 and 19, around the two holes 21 and 22, respectively.

Also welded to the upper end of each upright 8 of the mast element 2, in a horizontal plane, is a U-shaped mounting plate 25, the two branches of which are directed toward the inside of the square horizontal section of the mast element 2, parallel to the diagonal of this section. Formed in each branch of the mounting plate 25 is a hole, 26 or 27 respectively, the spacing of the two holes 26 and 27 corresponding to that of the two centering studs 16 and 17 placed at one corner of the pivot 1. The central cutout 28 of the mounting plate 25, which is the result of its U shape, is in alignment with the empty space formed between the two fishplates 18 and 19, located under this mounting plate 25.

Referring to FIGS. 1 and especially 6 and 7, the assembly of the pivot 1 with the mast element 2 will now be described. The pivot 1 is brought over the mast element 2, bringing the four corners of the pivot 1 into alignment with the tops of the four corner members 8 of the mast element 2. The pivot 1 is then lowered so that its four fishplates 11 engage respectively in the four yokes 10 of the mast element 2, the central cutout 28 of each mounting plate 25 allowing the corresponding fishplate 11 of the pivot 1 to pass freely.

Toward the end of the lowering of the pivot 1, the two centering studs 16 and 17 located at each corner thereof enter the two respective holes 26 and 27 of the corresponding mounting plate 25, and finally, the upper plate 5 of the pivot 1 comes to rest, via its four corner regions, on the four mounting plates 25 located at the top of the mast element 2.

In this position, the two holes 12 and 13 of each fishplate 11 of the pivot 1 come, respectively, into alignment with the pairs of holes 21 and 22 in the corresponding yoke 10. Two superposed horizontal connecting pins 29 and 30 (see FIG. 1) are then fitted, one of them through the aligned holes 12 and 21 and the other through the aligned holes 13 and 22, and this is done at the four corners of the pivot 1. Each connecting pin 29 or 30 is advantageously a pin with a long taper, fitted with a locking pin.

As goes without saying, the invention is not restricted to the single embodiment of this device for providing a connection between a pivot and a mast structure for tower cranes which has been described hereinabove by way of example; on the contrary, it encompasses all alternative forms of embodiment and application thereof which adhere to the same principle. In particular, it would not be departing from the scope of the invention if:

the number of fishplates of the pivot 1 and of the mast element 2 at each corner were to be modified, or the number of holes pierced in these fishplates for taking connecting pins were to be modified, provided the same fish-jointing principle were retained;

the device were to be applied to pivots and mast structures whose horizontal sections were of different dimensions than those indicated;

this device were to be adapted to fit the top of a mask element the uprights of which were of any shape, it also being possible for these uprights to be, in particular, tubes of square or rectangular cross section.

What is claimed is:

1. A device providing a connection between a pivot and a mast structure for tower cranes, the device providing dismantlable assembly between, on the one hand, the top of the mast of a tower crane, made up of mast elements of square horizontal section and, on the other hand, a fixed pivot, an envelope section having square overall shape and which serves to support and to orientate the rotating top part of the crane, comprising in particular the jib, which device comprises, in combination:

at each of the four comers of the pivot, at least one fishplate fixed in a vertical plane passing through a diagonal of the square horizontal section of the pivot, or parallel to this diagonal, each fishplate being pierced with at least one hole of horizontal axis, and all of the fishplates of the pivot lying within the permissible size for transporting this pivot;

at each of the four corners of the top of the upper mast element, at least one other fishplate fixed to the upper part of a comer member or upright of this mast element, on the inside of the upright, in a vertical plane passing through a diagonal of the square horizontal section of the mast element or parallel to this diagonal, each fishplate being pierced with at least one hole of horizontal axis, and all of the fishplates of the mast element lying inside the volume delimited by the four lateral faces of the mast element, and removable horizontal connecting pins designed to be engaged through the holes in the fishplates of the pivot and the holes in the fishplates of the mast element, these holes coming into alignment at each of the four comers when the pivot is placed on the top of the mast element.

2. The device providing a connection between a pivot and a mast structure as claimed in claim 1, wherein each fishplate of the pivot is fixed by welding under a corner region of the upper horizontal plate, generally square in shape, of the pivot.

3. The device providing a connection between a pivot and a mast structure as claimed in claim 2, wherein each fishplate of the pivot is also fixed by welding to adjacent regions of vertical reinforcing pieces located on the four sides of the pivot, under its upper plate, and connected to a shell cylinder of said pivot.

4. The device providing a connection between a pivot and a mast structure as claimed in claim 1, wherein the pivot comprises, at each of its four corners, a single fishplate located in the vertical plane passing through the diagonal of the square horizontal section of the pivot, whereas fixed to the upper part of each corner member or upright of the mast element are two parallel fishplates which are symmetric with respect to the vertical plane passing through the diagonal of the square horizontal section of the mast element, the two fishplates together forming a yoke in which the corresponding fishplate of the pivot can be inserted.

5. The device providing a connection between a pivot and a mast structure as claimed in claim 1, wherein two superposed holes are pierced in the fishplates of the pivot, and in the fishplates of the mast element, so that two superposed connecting pins can be fitted at each of the four corners.

6. The device providing a connection between a pivot and a mast structure as claimed in claim 1, wherein the holes pierced in the fishplates of the pivot and the holes pierced in the fishplates of the mast element, are fitted with hammering inserts.

7. The device providing a connection between a pivot and a mast structure as claimed in claim 1, wherein a horizontal mounting plate is welded to the upper end of each corner member or upright of the mast element, the upper horizontal plate of the pivot coming into alignment, at each of its corner regions, with the corresponding mounting plate.

8. The device providing a connection between a pivot and a mast structure as claimed in claim 7, wherein an upper plate of the pivot, bears in each comer region, at least one centering stud, directed downward, whereas each mounting plate of the mast element is pierced with at least one hole capable of accommodating a corresponding centering stud belonging to the pivot.

9. The device providing a connection between a pivot and a mast structure as claimed in claim 4, wherein each comer member or upright of the mast element has a U shape mounting plate with two branches directed toward the inside of the square horizontal section of the mast element, each branch being pierced with a hole and having a central cutout designed for the passage of the corresponding fishplate of the pivot, the horizontal upper plate of the pivot bearing, having in each comer region, two centering studs arranged symmetrically one on each side of the fishplate and designed to enter two holes in the corresponding mounting plate.

* * * * *